United States Patent [19]

Koinuma et al.

[11] Patent Number: 4,975,748

[45] Date of Patent: Dec. 4, 1990

[54] METHOD OF REMOVING A FILM FROM AN IMAGE CARRIER

[75] Inventors: Nobuyuki Koinuma, Yokohama; Chikara Imai; Yoshio Takamiya, both of Tokyo; Kazuyuki Sugihara, Kawasaki; Yuji Sawai, Yokohama, all of Japan

[73] Assignee: Ricoh Company, Ltd., Tokyo, Japan

[21] Appl. No.: 459,315

[22] Filed: Dec. 29, 1989

[30] Foreign Application Priority Data

| | | | |
|---|---|---|---|
| Jan. 9, 1989 | [JP] | Japan | 1-2187 |
| Jan. 9, 1989 | [JP] | Japan | 1-2188 |
| Mar. 24, 1989 | [JP] | Japan | 1-73474 |
| Mar. 24, 1989 | [JP] | Japan | 1-73475 |
| Aug. 5, 1989 | [JP] | Japan | 1-203459 |
| Dec. 1, 1989 | [JP] | Japan | 1-312628 |

[51] Int. Cl.[5] ..... G03G 21/00

[52] U.S. Cl. ..... 355/305; 118/652; 355/296

[58] Field of Search ..... 355/305, 303, 302, 296, 355/297, 215, 306, 270; 118/652; 430/125

[56] References Cited

U.S. PATENT DOCUMENTS

| | | | |
|---|---|---|---|
| 4,095,980 | 6/1978 | Satomi | 355/303 X |
| 4,154,522 | 5/1979 | Ikesue | 355/296 X |
| 4,355,886 | 10/1982 | Perez et al. | 355/303 X |
| 4,470,694 | 9/1984 | Murakami et al. | 355/303 X |
| 4,502,780 | 3/1985 | Suzuki et al. | 355/305 |
| 4,515,467 | 5/1985 | Suzuki | 355/302 X |
| 4,547,063 | 10/1985 | Stange | 355/305 |
| 4,885,612 | 12/1989 | Satoh et al. | 355/305 |

*Primary Examiner*—A. T. Grimley
*Assistant Examiner*—Sandra L. Hoffman
*Attorney, Agent, or Firm*—Oblon, Spivak, McClelland, Maier and Neustadt

[57] ABSTRACT

A method of removing a film which undesirably forms on a photoconductive element or similar image carrier of an image forming apparatus such as an electrophotographic copier, printer or facsimile machine. The method is implemented by a cleaning device having a cleaning sleeve which removed toner particles remaining on the image carrier after image transfer. In a film removing mode which is executed when an image forming mode for forming a toner image on the image carrier is not under way, the cleaning sleeve is rotated at a lower speed than in an ordinary cleaning mode so as to feed a greater amount of cleaning agent to a cleaning region. The rotation speed of image carrier and that of the cleaning sleeve are controlled in such a manner as to feed a predetermined adequate amount of cleaning agent for the removal of a film to the cleaning region at all times.

13 Claims, 17 Drawing Sheets

METHOD OF REMOVING A FILM FROM AN IMAGE CARRIER

BACKGROUND OF THE INVENTION

The present invention relates to a method of removing a film from an image carrier of an image forming apparatus.

An image forming apparatus of the type electrostatically forming a latent image on an image carrier, developing the latent image by a toner, and transferring the resulting toner image to a paper sheet is extensively used. This kind of apparatus is implemented as a printer or a facsimile machine, for example. A problem with such an apparatus is that while the image carrier is repetitively used, various particles such as toner, paper dust and additives contained in paper are apt to form a thin film on the image carrier. Filming on the image carrier locally increases the density of a toner image and contaminates the background, thereby degrading the quality of the toner image to a critical extent. Various approaches have heretofore been proposed to remove such a film from the image carrier. Typical of prior art approaches are an abrasive or an abrasive brush for polishing the surface of the image carrier, and a blade for scraping the film off the surface of the image carrier in pressing contact with the latter, as disclosed in Japanese Patent Laid-Open Publication (Kokai) Nos. 62-119567, 60-107076, and 60-119589 by way of example.

However, the prior art approaches stated above have some problems left unsolved. Specifically, the abrasive brush or similar extra member for removing the film adds to the cost of the image forming apparatus. Moreover, the brush or the blade which contacts the image carrier is apt to cause the image carrier to wear to thereby produce unusual stripe-like images while reducing the service life of the image carrier.

SUMMARY OF THE INVENTION

It is therefore an object of the present invention to provide a film removing method free from the drawbacks particular to the prior art as discussed above.

It is another object of the present invention to provide a method capable of effectively removing a film from an image carrier of an image forming apparatus.

In accordance with the present invention, in a method of removing a film from an image carrier of an image forming apparatus comprising the image carrier which is movable for forming a toner image on the image carrier in an image forming mode, a movable agent carrier located to face the image carrier for magnetically retaining an agent and transporting the agent to a region between the image carrier and the agent carrier while causing the agent to form a magnet brush, and a regulating member for regulating the amount of the agent being transported to the region, the improvement wherein at a time when the image forming mode for forming the toner image on the image carrier is not under way, a film removing mode is executed by controlling the movement of the image carrier and that of the agent carrier such that an adequate amount of the agent is transported to the region.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
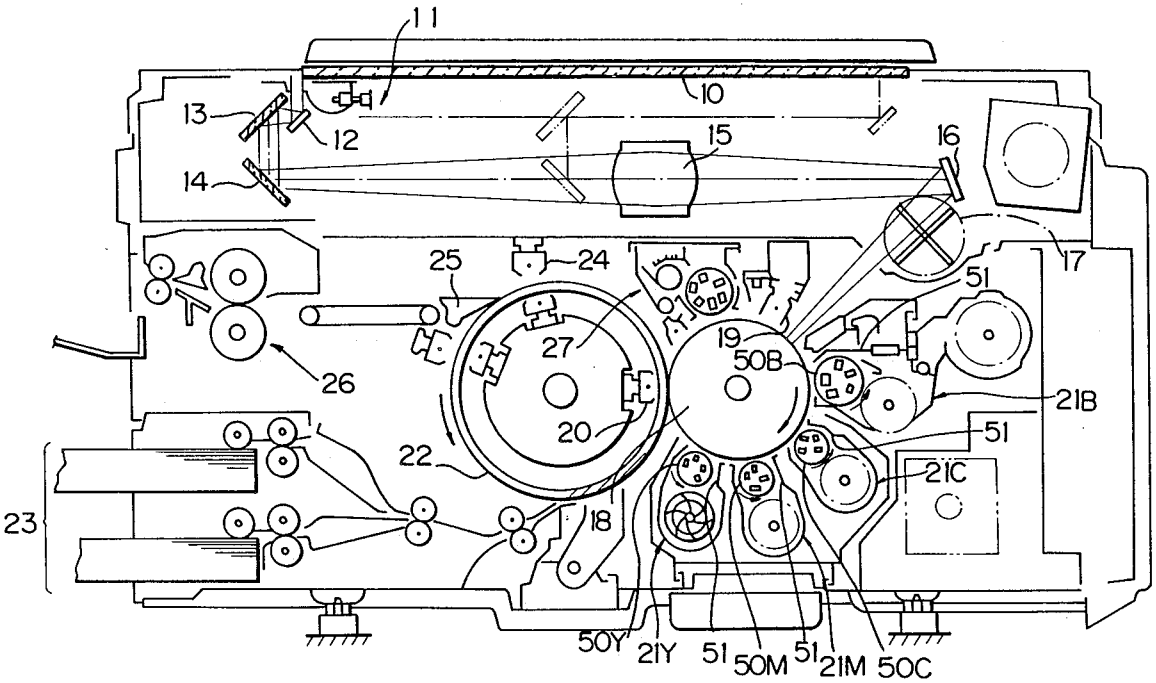
FIG. 1 is a copier belonging to a family of image forming apparatuses to which the present invention is applicable.

To better understand the present invention, a brief reference will be made to the general construction of a color copier having a cleaning device to which the present invention is applied by way of example, shown in FIG. 1. As shown, the copier has a glass platen 10 on which an original document (not shown) is laid. An illuminating device 11 is moved together with a first mirror 12 to the right as viewed in the figure, while illuminating the document on the glass platen 10. A reflection from the document is incident to a lens 15 via a second mirror 13 and a third mirror 14 which are moved in the same direction as the first mirror 12. The lens 15 focuses the imagewise reflection onto a photoconductive element 18 by way of a fourth mirror 16 and a filter assembly 17. The photoconductive element is a specific form of an image carrier and, in this embodiment, implemented as a drum. The filter assembly 17 has a plurality of color separating filters and is rotatable by each 90 degrees to select any one of the filters. The filter assembly 17 separates a blue component, for example, by one of the filters. The blue component is focused onto the drum 18 which has been uniformly charged by a charger 19, whereby a latent image is electrostatically formed on the drum 18.

A yellow, a magenta and a cyan developing unit 21Y, 21M and 21C, respectively, are located below the drum 18. A latent image formed on the drum 18 by the above procedure is developed by a yellow toner which is stored in the yellow developing unit 21Y. The resulting toner image is transferred by a transfer charger 20 to a paper sheet which has been fed from a sheet feed section 23 and wound around a transfer drum 22. The paper sheet is representative of an image recording medium applicable to the copier. In the same manner, a magenta toner image and a cyan toner image are individually transferred from the drum 18 to the paper sheet one upon the other. A black developing unit 21B is also installed in the copier for developing a latent image by a black toner. A black toner image is formed by using or not using an ND filter. In FIG. 1, 50Y, 50M, 50C and 50B designate respectively the developing sleeves individually installed in the developing units. Each of the developing sleeves carries a developer thereon and transports it to develop a toner image formed on the drum 18.

After the image transfer, the paper sheet is separated from the drum 22 by an exclusive charger 24 and a pawl 25 and then driven out of the copier via a fixing device 26. Every time a toner image is transferred from the drum 18 to the paper sheet, the drum 18 is cleaned by a cleaning device 27 so as to remove residual toner particles and is thereby prepared for the next image forming cycle.

The cleaning device 27 to which the present invention is applied is usually constructed and operated as follows.

Figure 2:
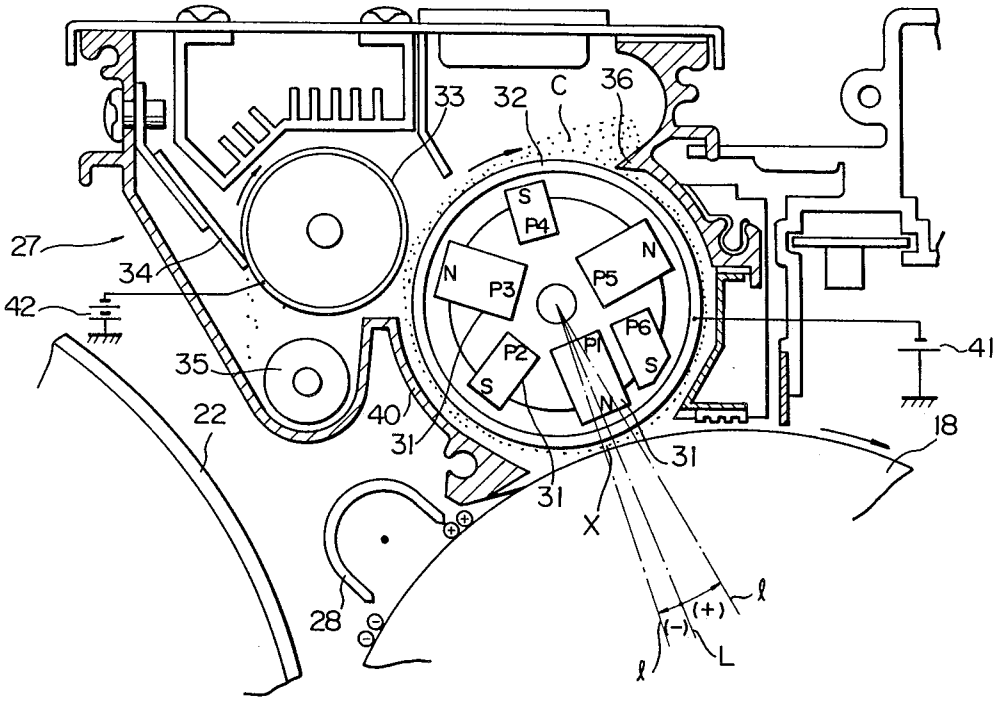
FIG. 2 is an enlarged section of a cleaning device.

As shown in FIG. 2, a precleaning charger 28 is located in a position downstream of an image transfer position where the drum 18 and transfer drum 22 contact each other, with respect to the direction of rotation of the drum 18. The precleaning charger 28 is oriented to face the drum 18. The cleaning device 27 has a cleaning sleeve 32 which is positioned downstream of the precleaning charger 28 and made of a non-magnetic material such as aluminum. A plurality of magnets 31 are accommodated in the cleaning sleeve 32 (the individual magnets 31 are labeled P1 to P6). The cleaning sleeve 32 is a specific form of an agent carrier for carrying a cleaning agent. In the cleaning device 27, the cleaning sleeve 32 is rotated by a motor (not shown) clockwise as indicated by an arrow in FIG. 2 relative to the stationary magnets 31. Designated by the reference numeral 40 is a cleaning case of the cleaning device 27 which is open in a position where it faces the drum 18. The cleaning sleeve 32 is, therefore, partly exposed to the drum 18 through the opening of the cleaning case.

As the toner particles remaining on the drum 18 after image transfer arrives as the precleaning charger 28, the charger 28 deposits a charge of predetermined polarity (positive in this example) on the residual particles by corona discharge so as to facilitate the removal of the particles.

On the other hand, the magnets 31 accommodated in the cleaning sleeve 32 magnetically retain on the periphery of the cleaning sleeve 32 a cleaning agent C which is the mixture of magnetic carrier and magnetic or non-magnetic toner, the carrier forming a magnetic brush. More specifically, the magnets 31 magnetically attract the carrier particles onto the cleaning sleeve 32 so as to retain the cleaning agent C on the sleeve 32. A toner is sometimes implemented by a toner only and sometimes by a mixture of toner and additive. In any case, the toner particles and the carrier particles are charged by friction to opposite polarities resulting in the toner particles being electrostatically deposited on the carrier particles. As the cleaning sleeve 32 is rotated clockwise, the cleaning agent C at least a part of which is constituted by a magnetic substance is transported by the sleeve 32 and caused into contact with the surface of the drum 18 at a cleaning region X. When the residual toner having been charged by the precleaning charger 28 arrives at the cleaning region X where it faces the cleaning sleeve 32, it is deposited by electrostatic attraction and mechanical scavenging force on the cleaning carrier which is retained on the cleaning sleeve 32. In this instance, a bias voltage opposite in polarity to the toner (negative in this example) is applied to the cleaning sleeve 32 from a power source 41 so that the cleaning carrier is negatively charged. In this manner, the residual toner on the drum 18 is removed by the cleaning agent C.

The carrier on which the residual toner has been deposited is transported by the cleaning sleeve 32 while forming a magnet brush on the sleeve 32. A toner collecting roller 33 is made of metal, for example, and applied with a bias voltage of predetermined polarity (negative in this example) from a power source 42. When the carrier on the sleeve 32 arrives at a position where it faces the toner collecting roller 33, it is brought into contact with the roller 33 and electrostatically deposited on the latter. In this condition, only the positively charged toner is transferred from the cleaning sleeve 32 to the toner collecting roller 33, while the negatively charged carrier is left on the cleaning sleeve 32. At this instant, a certain amount of toner is left on the cleaning sleeve 32 and turns out to be the toner contained in the cleaning agent C. A blade 34 is made of elastic rubber or resilient metal and held in contact with the roller 33 which rotating clockwise. The blade 34, therefore, scrapes the toner off the collecting roller 33. The toner so scraped off the collecting roller 33 is discharged to the outside of the cleaning unit 27 by a screw 35.

The cleaning agent C on the cleaning sleeve 32 is further transported to a doctor blade 3. The doctor blade 3 regulates the thickness of the cleaning agent C to about 0.5 millimeter to about 2.0 millimeters, the regulated agent C being again fed into the cleaning region X. This is followed by the above-stated iterative procedure.

The doctor blade 36 is a specific form of regulating means for regulating the amount of cleaning agent to be transported to the cleaning region X between the drum 18 and the cleaning sleeve 32 and thereby promoting adequate cleaning.

As described above, the copier shown in FIGS. 1 and 2 has the drum 18 for carrying a toner thereon during an image forming mode, cleaning sleeve 32 located to face the drum 18 for transporting the cleaning agent C while magnetically retaining it thereon, and the doctor blade 36 for regulating the amount of cleaning agent C to be transported to the region X between the drum 18 and the sleeve 32.

Specific conditions of the various components included in the copier, especially the cleaning device 27, shown in FIGS. 1 and 2 are as follows:

(1) Flux density as measured at the pole of magnet P1 shown in FIG. 2: 1000 gauss to 1100 gauss (2) Flux density as measured at the pole of magnet P2: 1200 gauss to 1300 gauss (3) Position of magnet P1 constituting the main pole: Assuming that a line L connecting the centers of the cleaning sleeve 32 and drum 18 is the reference, and that a line l passing through the center of the sleeve 32 defines a positive (+) and a negative (−) angle relative to the line L as shown in FIG. 2, the magnet P1 is located in an angular range of −2 degrees to +8 degrees.

(4) Bias voltage applied to cleaning sleeve 32 from power source 41: DC−150 volts (5) Bias voltage applied to toner collecting roller 33 from power source 42: DC−500 volts (6) Linear velocity (pheripheral speed) (VS) of cleaning sleeve 32 during ordinary cleaning: 300 millimeters per second (7) Linear velocity (peripheral speed) (VP) of drum 18: 200 millimeters per second (8) Gap between the cleaning sleeve 32 and doctor blade 36: 0.8 millimeter (9) Ga between cleaning sleeve 32 and drum 18: 1.0 millimeter (10) Toner concentration in cleaning agent C relative to carrier: 0.5 to 2 weight percent (11) Charge deposited on toner in cleaning agent C: 10 to 80 microcoulombs per gram (12) Carrier configuration in cleaning agent: irregular In the cleaning device 27 stated above, among the toner particles transferred from the drum 18 to the cleaning sleeve 32, those insufficiently charged and those left non-charged despite the operation of the pre-cleaning charger 28 are caused to float off the cleaning sleeve 32 and often deposit on the drum 18 again. Besides, toner particles scattered around from the developing units 21Y, 21M, 21C and 21B, paper dust and additives contained in paper are apt to deposit on the surface of the drum 18. Such toner particles and paper dust are sequentially adhered to the drum surface with the lapse of time, filming the drum surface. The filming renders the sensitivity distribution of the drum 18 irregular to thereby produce an irregular density distribution of a toner image on the drum 18 or to contaminate the background. It is necessary, therefore, to remove the film from the drum 18 as soon as possible or to prevent such particles from filming on the drum 18.

The copier described above removes the film by using the cleaning device 27. Specifically, at a time other than the time when an image forming mode for forming a toner image on the drum 18 is under way as stated earlier, i.e., in a film removing mode, a greater amount of cleaning agent than during an ordinary cleaning operation is fed to the region X between the drum 18 and the cleaning sleeve 32 in the film removing mode. More specifically, the drum 18 is operated with a greater amount of cleaning agent C being filled in the region X than during ordinary copying operation. In this condition, a mass of cleaning agent stays in the cleaning region X so that the carrier particles of the cleaning agent C is strongly rubbed against the surface of the drum 18 to scrape the film off the drum 18. Such a manner of removal is implemented by the increase in the contact pressure acting between the cleaning agent C, i.e., magnet brush and the surface of the drum 18 as well as the increase in their coefficient of friction. This is successful in removing the film or preventing such a film from forming on the drum 18. Even if the drum 18 has some eccentricity, the mass of cleaning agent C staying in the region X will remove the film over the entire surface of the drum 18.

Let the construction described above be referred to as a first specific construction hereinafter.

In the cleaning device 27 of the type rotating the cleaning sleeve 32 relative to the stationary magnets 31 to transport the cleaning agent C, the amount of cleaning agent C to be fed to the cleaning region X can be increased for the purpose of removing a film only if the sleeve 32 is rotated at a lower speed than during an ordinary cleaning operation. Specifically, when the linear velocity of the cleaning sleeve 32 is lowered, the centrifugal force acting on the cleaning agent C which is retained thereon is weakened so that the agent C is strongly attracted onto the surface of the sleeve 32. Consequently, a greater amount of cleaning agent C is transported away from the doctor blade 36 toward the cleaning region X.

Assume that the linear velocities of the cleaning sleeve 32 and drum 18 are VS and VP, respectively. Experiments showed that a film can be efficiently removed without the drum 18 and sleeve 32 being stopped if the linear velocities VS and VP are so selected as to satisfy a relation $0 < |VS/VP| < 0.5$ (cleaning sleeve 32 rotating at a speed of about 10 r.p.m., for example) when a greater amount of cleaning agent C is fed to the cleaning region for removing a film, and a relation $|VS/VP| > 0.5$ when the amount of cleaning agent C is to be reduced. These specific values will be collectively referred to as an eighth specific construction hereinafter for convenience. It is to be noted that the eighth specific construction applies not only to the previously discussed first construction but also to other various specific constructions which will follow. In an ordinary cleaning mode, the linear velocities VS and VP may be selected such that a relationship $|VS/VP| > 0.5$ is satisfied.

A more specific operation of the first specific construction will be described with reference to FIG. 3.

Figure 3:
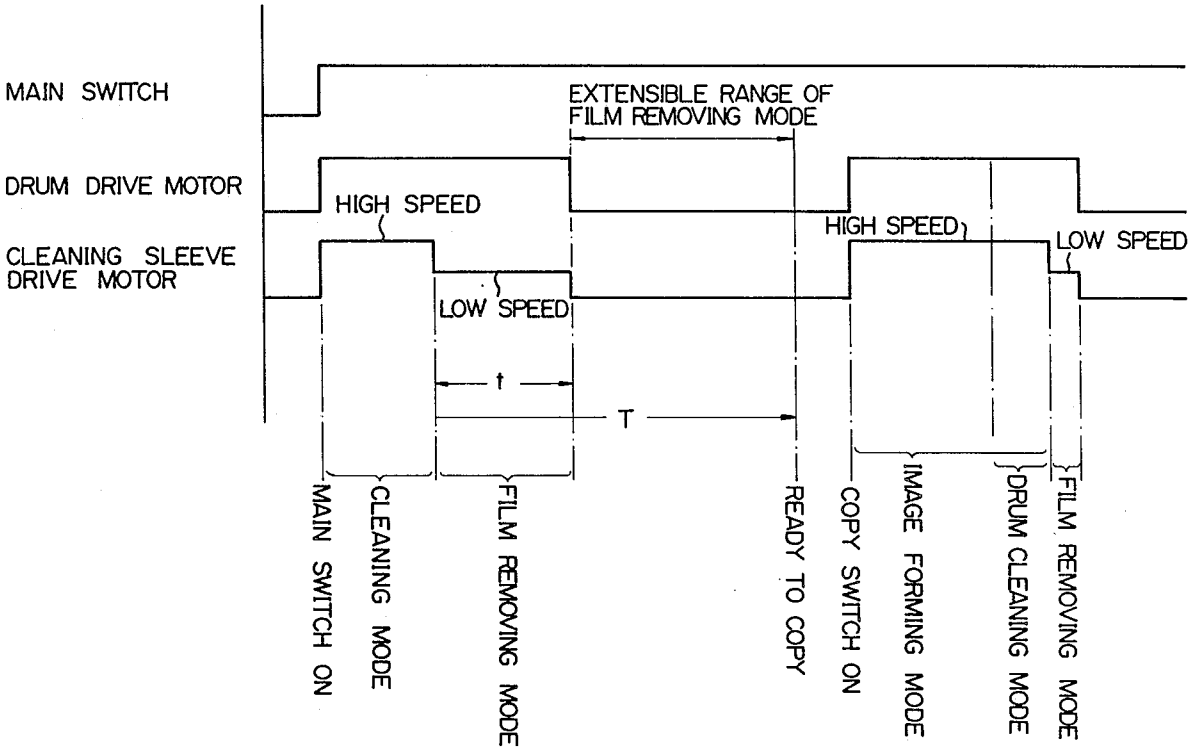
FIG. 3 is a timing chart representative of a sequence of operations including a film removing operation as performed by the copier of FIG. 1.
Figure 4:
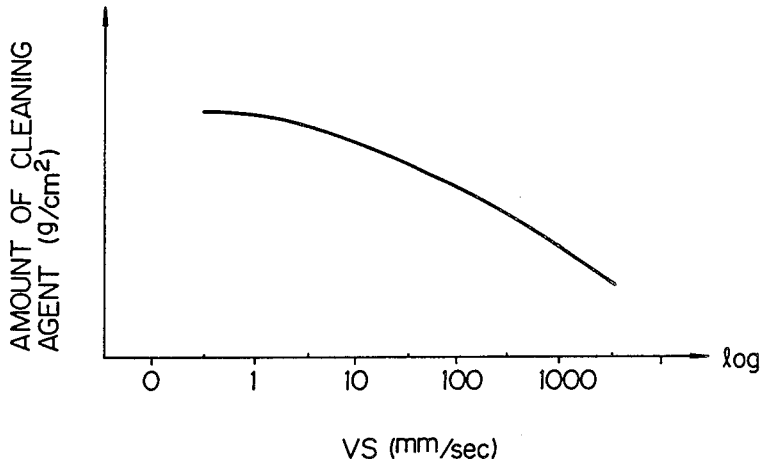
FIG.4 is a graph showing a relationship between the linear velocity of a cleaning sleeve and the amount of cleaning agent transported.

In FIG. 3, when the main switch of the copier is turned on, the copier starts on a drum cleaning mode operation. Specifically, a drum drive motor is energized to rotate the drum 18 while a cleaning sleeve drive motor is energized to rotate the cleaning sleeve 32 clockwise as viewed in FIG. 2. In this condition, toner particles remaining on the drum 18 are deposited on the cleaning agent C, more precisely on the carrier, which is retained on the cleaning sleeve 32, whereby the drum 18 is cleaned. On the lapse of a predetermined period of time, the cleaning mode is replaced with a film removing mode. In the film removing mode, the cleaning sleeve 32 is rotated at a low speed ($0 < |VS/VP| < 0.5$) according to the previously stated eighth specific construction to increase the amount of cleaning agent being transported to the cleaning region X. Examples of the ratio VS/VP under the low-speed rotation of the cleaning sleeve 32 is 17 millimeters per second/300 millimeters per second, i.e. 0.06. FIG. 4 is a graph showing a specific relationship between the linear velocity VS of the cleaning sleeve and the amount of cleaning agent transported to the cleaning region X (FIG. 2). As shown, as the rotating speed of the cleaning sleeve 32 decreases, the amount of cleaning agent transported is increased to enhance the removal of a film.

In FIG. 3, labeled T is the interval between the end of the drum cleaning mode and the end of warm-up of the fixing device or similar component of the copier to a predetermined temperature. While the film removing operation is shown as continuing only during a part t of the period of time T, it may be effected over any suitable range within the period of time T or even throughout the period of time T. This is what is meant by the words "extensible range of film remove mode" shown in FIG. 3. On the lapse of the period of time T, the copier is ready to operated and will start operating when a copy start key thereof is pressed. The drum 18 is cleaned during and after a sequence of copying operations. This is followed by the film removing mode in which the cleaning sleeve 32 is rotated at the lower speed to increase the amount of cleaning agent being transported to the cleaning region X.

It will be seen from the above that the film removing operation in accordance with the present invention can be executed at any suitable time other than the time at which the image forming mode is under way.

As stated above, in the first specific construction, an amount of cleaning agent great enough to scrape a film off the drum 18 is transported to the region X between the drum 18 and the cleaning sleeve 32 when an image forming operation is not performed, thereby removing a film effectively. This kind of implementation does not need any extra member for removing a film and, therefore, cuts down the cost of the apparatus. Moreover, no excessive external forces act on the drum 18 in contrast to the prior art implementation which relies on an abrasive brush or a blade. An abrasive brush or a blade held in pressing contact with the drum 18 would cause the latter to wear soon or scratch the latter to reduce the service life.

The embodiment (first specific construction) described above is constructed and arranged to feed a great amount of cleaning agent to the cleaning region X in the film removing mode. Alternatively, an arrangement may be made that in the film removing mode the rotation of the cleaning sleeve 32 is interrupted with the drum 18 being continuously rotated so as to stop the transport of the cleaning agent C. Then, the magnet 31 will seize the cleaning agent existing between the drum 18 and the cleaning sleeve 32 while causing the latter to form a magnet brush. This magnet brush is as effective as the great amount of cleaning agent transported to the region X in removing a film from the drum 18 or preventing it from being formed on the drum 18. When the transport of cleaning agent is stopped with the drum 18 being rotated as stated above, the contact pressure and coefficient of friction between the magnet brush and the drum surface increase to promote the removal of a film. Further, immediately after the stop of the cleaning agent, the toner deposited on the carrier of the cleaning agent which contacts the drum 18 is captured by the drum 18 or it escapes sideways from the portions where the cleaning agent contacts the drum 18. Consequently, the carrier directly contacts the drum surface to further promote the removal of a film. This kind of construction will hereinafter be referred to as a second specific construction.

Figure 5:
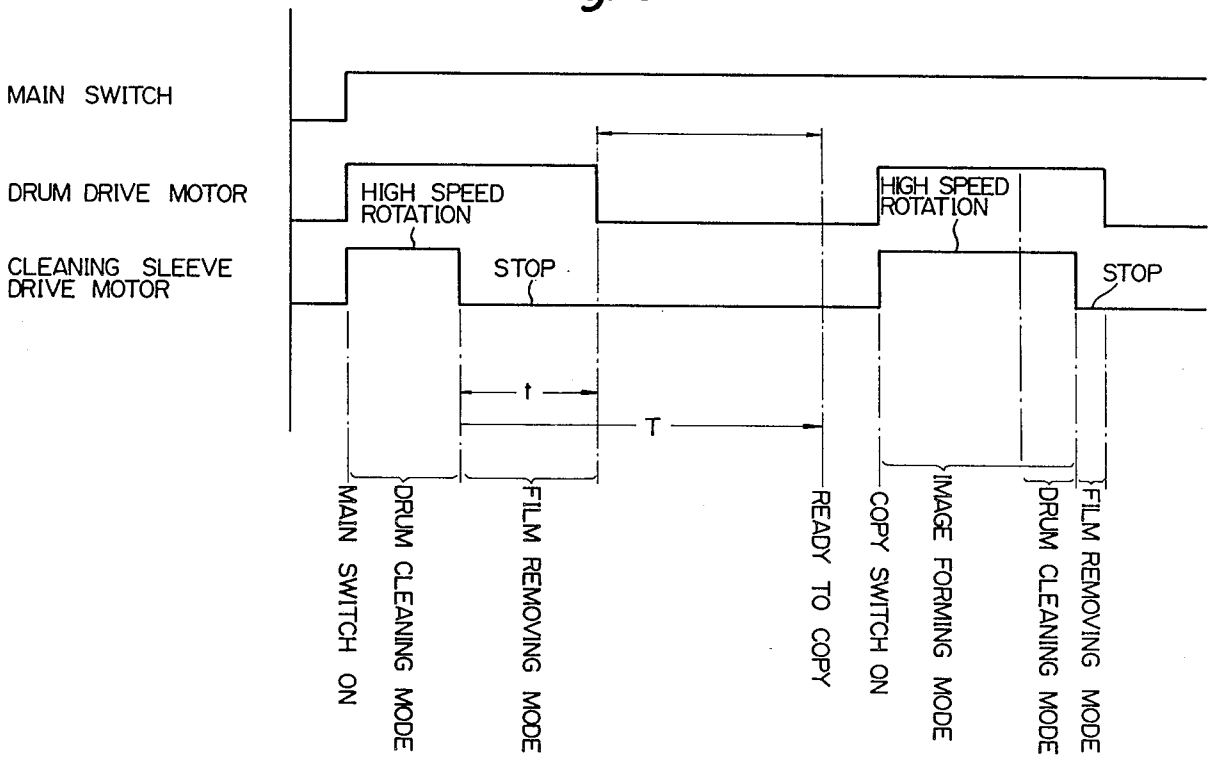
FIGS. 5 and 6 are vieews similar to FIG. 3, showing a second and a third specific construction, respectively.

Referring to FIG. 5, there is shown a timing chart demonstrating the operation of the second specific construction. The procedure of FIG. 5 differs from the procedure of FIG. 3 in that in the film removing mode the drum drive motor is energized to rotate the drum 18 while the cleaning sleeve drive motor is deenergized to stop the rotation of the cleaning sleeve 32.

Stopping the cleaning agent in the film removing mode as stated above is successful in removing a film from the drum 18. This is insufficient, however, considering the eccentricity of the drum 18. Specifically, when the drum 18 has some eccentricity, the magnet brush is apt to fail to contact the drum 18 at some movment or, if it is successfully held in contact, the contact pressure is apt to decrease to a noticeable degree. Then, magnet brush will fail to remove a film evenly.

To eliminate the above occurrence, a third specific construction in accordance with the present invention repeats more than once a step of interrupting the transport of the cleaning agent by stopping the rotation of the cleaning sleeve 32 as stated and a step of transporting the cleaning agent by rotating the cleaning sleeve 32. While the transport of the cleaning agent C is stopped, the operation for removing a film from the drum 18 is performed as in the seconde specific construction. Subsequently, the cleaning agent is deposited on and transported by the cleaning sleeve 32 and, therefore, brought into contact with the drum 18 by changing its form in association with the eccentricity of the drum 18. These steps are repeated to cause the magnet brush to positively contact the drum 18, thereby insuring uniform removal of a film from the drum 18. Since the carrier contacting the drum 18 changes is replaced due to the movement of the cleaning agent, the film removing effect is further enhanced.

Figure 6:
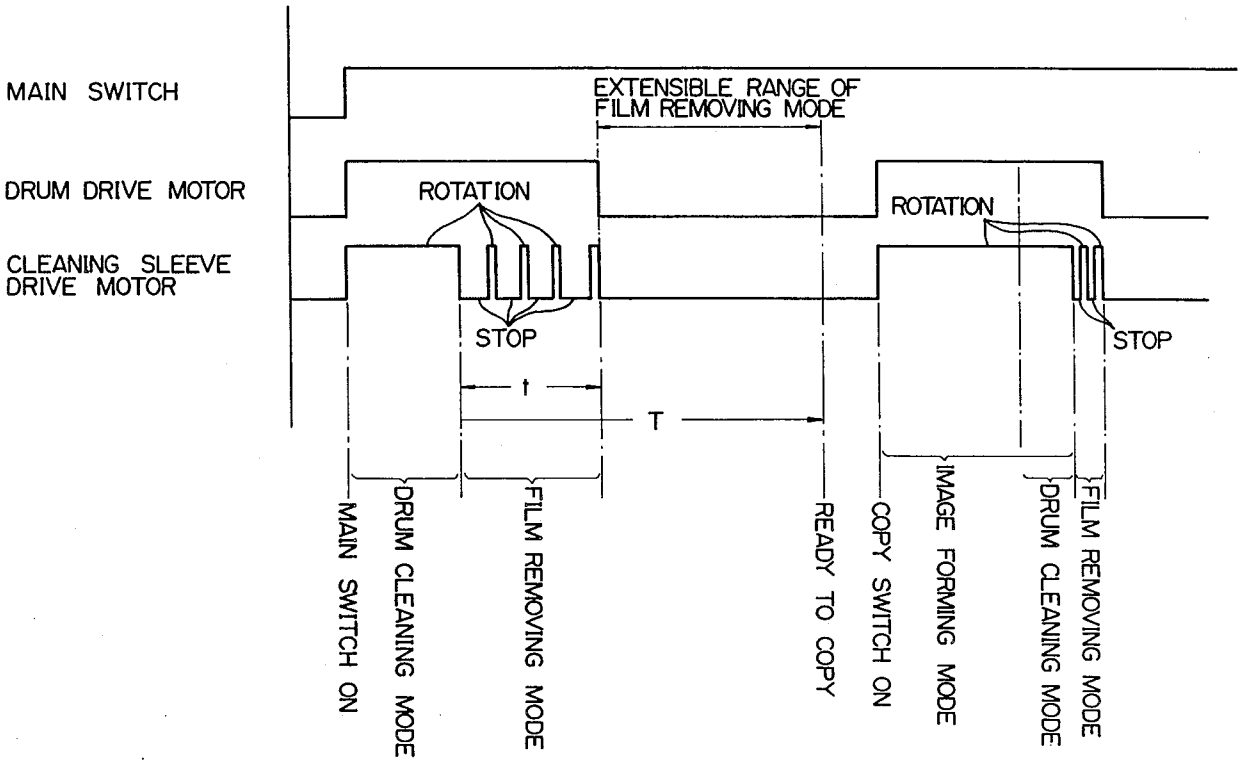

The operation of the third specific construction is shown in a timing chart in FIG. 6. As shown, in the film removing mode the drum drive motor is energized to rotate the drum 18, while the cleaning sleeve drive motor and, therefore, the cleaning sleeve 32 is stopped and rotated alternately to transport the cleaning agent intermittently. The durations of activation and deactivation of the cleaning sleeve 32 may be suitably selected. The rest of the construction and operation is essentially the same as the first specific construction.

Figure 7:
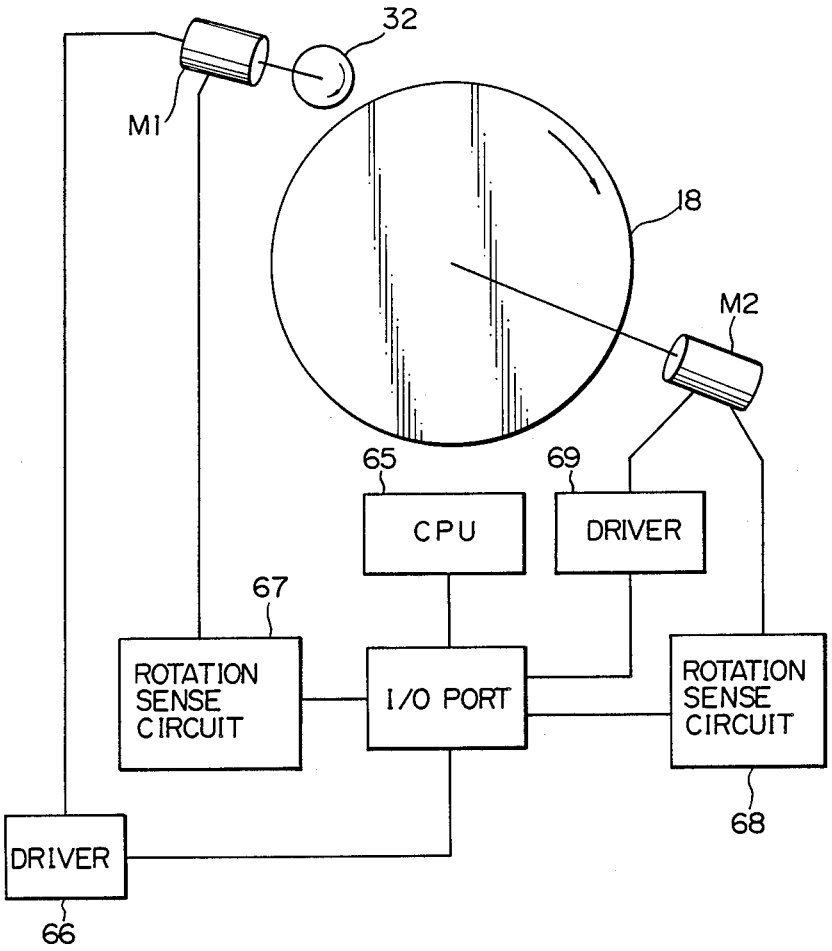
FIG. 7 is a schematic block diagram showing a specific control system which is representative of a fourth specific construction.

Changing the rotation speed of the cleaning sleeve 32 from the ordinary cleaning mode to the film removing mode as in the first specific construction may be implemented by control means which is schematically shown in FIG. 7. As shown, a cleaning sleeve drive motor M1 for driving the cleaning sleeve 32 is implemented as a stepping motor. A CPU (Central Processing Unit) 65 feeds its output to the motor M1 vai a driver 66 for thereby driving the motor M1. Specifically, the CPU 65 feeds a different output to the motor M1 in each of the ordinary cleaning mode and film removing mode, so that the motor M1 and, therefore, the cleaning sleeve 32 is rotated at a different adequate speed in each of the two modes.

As stated above, the motor M1, driver 66 and CPU 65 in combination constitute control means for controlling the amount of cleaning agent such that an amount of cleaning agent great enough to scrape a film off an image carrier (drum 18) is fed to a region between the image carrier and an agent carrier (cleaning sleeve 32) at a suitable timing other than image forming timings. In FIG. 7, a drum drive motor M2 is provided which is driven by a command from the CPU 65 via a driver 69.

While the cleaning agent C staying in the cleaning region X and sequentially increasing in amount as stated above is successful in promoting effective removal of a film from the drum 18, it may occur that the agent filling the region X constitutes a substantial load on the drum 18 due to friction and, in the worst case, this load is sequentially increased to such an extent that the drum 18 and cleaning sleeve 32 are disabled to rotate. Such an occurrence will hereinafter be referred to as blocking. Blocking not only stops the rotation of the motors M1 and M2 but also prevents a film from being removed. Should blocking continue over a substantial period of time, the supply of such a great amount of cleaning agent C to the cleaning region X would become meaningless. Although such a problem will of course be eliminated if the amount of cleaning agent fed to the cleaning region X is suppressed or if a greater gap is defined between the drum 18 and the cleaning sleeve 32, then the film removing effect will be degraded.

In the light of the above, a fourth specific construction in accordance with the present invention has, in addition to the components of the first specific construction, an implementation for sensing the rotation speed of at least one of the cleaning sleeve 32 and drum 18 and, when the rotation speed is reduced to zero or beyond a predetermined value, reducing the amount of cleaning agent being transported to the cleaning region X. This is successful in reducing the load acting on the sleeve 32 and drum 18 and, therefore, in preventing them from remaining in a halt.

In the specific arrangement shown in FIG. 7, a rotation sensing circuit 67 is implemented as an encoder or a photointerrupter, for example, and senses the rotation of the cleaning sleeve drive motor M1. The output of the sensing circuit 67 is fed to the CPU 65. Assume that the rotation speed of the cleaning sleeve 32 has been lowered to a value which is about to cause the previously mentioned blocking and the rotation speed of the motor M1 associated with the sleeve 32 has consequently been lowered to 10 r.p.m. to 20 r.p.m, for example (the rotation speed of the sleeve 32 is 1 r.p.m. to 2 r.p.m.). Then, the CPU 65 immediately delivers a command to the driver 66 to increase the rotation speed of the motor M1 to 1800 r.p.m, for example, which is assigned to the ordinary cleaning mode (the cleaning sleeve 32 is rotated at 180 r.p.m). When the rotation speed of the motor M1 and, therefore, that of the cleaning sleeve 32 is increased as described above, the centrifugal force acting on the cleaning agent C is increased to render it easy to slip on the surface fo the sleeve 32. As a result, the amount of cleaning agent C being transported to the region X via the doctor blade 36 is reduced to substantially the same amount as during ordinary cleaning operation, for example. Hence, the load acting on the drum 18 and sleeve 32 is reduced before it increases to stop their rotation, i.e., the rotation of the motors M1 and M2.

Rotating the cleaning sleeve 32 at the higher speed by one or more rotations suffices to eliminating blocking. Thereafter, the rotation speed of the sleeve 32 will be lowered again so as to sequentially increase the cleaning agent C being transported to the cleaning region X for the removal of a film. In this manner, processing against blocking is completed within a short period of time. When the critical state which is about to cause blocking as discussed above occurs again, the above operation will be repeated. The sequence of steps described so far is performed for a predetermined period of time to terminate the film removing mode. It is to be noted that the cleaning sleeve 32 should preferably be restored from the higher speed to the lower speed because the film removing operation is interrupted while the sleeve 32 is rotated at the higher speed.

Since the cleaning sleeve 32 and drum 18 are free from blocking, a gap optimum for cleaning and film removal can be defined between the sleeve 32 and the drum 18 by ignoring blocking, further enhancing the cleaning effect and film removing effect. Alternatively, the sleeve drive motor M1 may be controlled such that its rotation is increased immediately after the sleeve 32 has been completely stopped due to blocking i.e., when its rotation speed has been reduced to zero.

As also shown in FIG. 7, the rotation speed of the drum drive motor M2 may be sensed by an exclusive rotation sensing circuit 68. When the sensing circuit 68 senses a rotation speed of the motor M2 which is representative of a blocking or near-blocking state of the drum 18 (e.g. a decrease in the speed of the drum 18 by about 10% of the ordinary speed), the motor M1 and, therefore, the cleaning sleeve 32 is rotated at a higher speed in exactly the same manner as has been described in relation to the sensing circuit 67. Then, the amount of cleaning agent being fed to the region X will also be decreased.

Whether or not to provide both of the rotation sensing circuits 67 and 68 is open to choice. In this particular construction, such a rotation sensing circuit or circuits serve as means for sensing the rotation speed of at least one of the agent carrier (cleaning sleeve 32) and image carrier (drum 18). The sensing means may alternatively be implemented as a sensing device responsive to an input current to at least one of the motors M1 and M2. Specifically, when the cleaning agent C exerts an excessive load on the motor or motors M1 and M2, the sensing device senses the resulting overcurrent which flows through the motors to thereby detect a blocking or near-blocking condition.

In the illustrative construction, the doctor blade 36, CPU 65 and rotation control circuit 66 constitute control means for controlling the amount of cleaning agent being transported to the region X when the rotation speed is reduced to zero or beyond a predetermined value.

Repetitively driving the cleaning sleeve 32 at a predetermined low speed and a predetermined high speed in the film removing mode will be as effective as the procedure of the fourth specific construction. For example, the linear velocities of the sleeve 32 and drum 18 may be so selected as to satisfy $0<|VS/VP|<0.5$ and $|VS/VP|>0.5$ when the sleeve 32 is rotated at a low speed and at a high speed, respectively. Such an alternative scheme, however, causes the cleaning sleeve 32 to be unconditionally rotated at the high speed at a given moment even when increasing its rotation speed to decrease the amount of cleaning agent C being fed to the region X is not necessary. This is apt to degrade the film removing efficiency.

Figure 8:
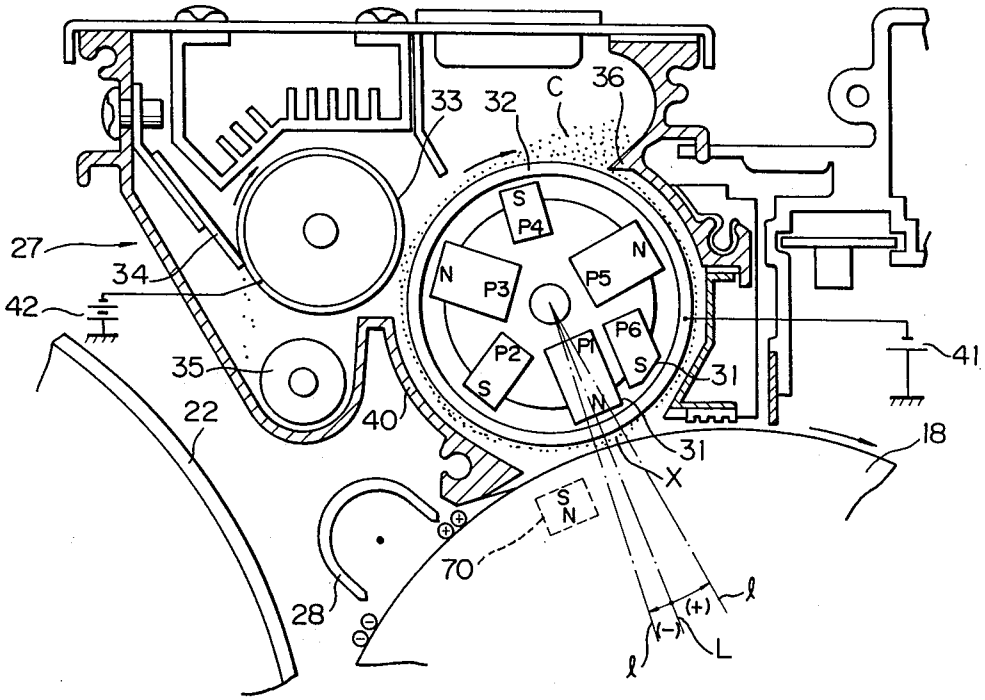
FIG. 8 is a view similar to FIG. 2, showing a fifth specific construction.
Figure 9:
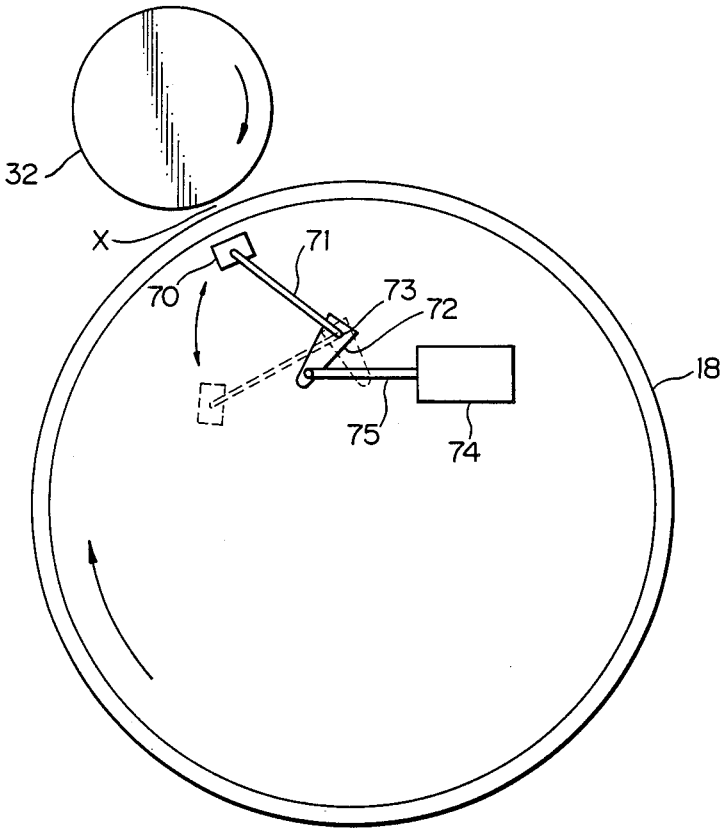
FIG. 9 shows major components of a fifth specific construction.

Referring to FIGS. 8 and 9, a fifth specific construction in accordance with the present invention is shown. The cleaning device 27 and the associated part of the copier shown in FIG. 8 are essentially the same in construction and operation as those shown in FIGS. 1 and 2. As shown, a magnet 70 which is a specific form of counter pole is disposed in the drum 18 in such a manner as to face the magnet P1 of the cleaning sleeve 32. The magnet 70 has south pole facing the north pole of the magnet P1 and is slightly deviated to the left, as viewed in the figure, of a line L interconnecting the centers of rotation of the cleaning sleeve 32 and drum 18, i.e., to the left-hand side of the cleaning region X. As shown in FIG. 9, the magnet 70 is affixed to an arm 71 which is in turn connected to a support plate 72. The support plate 72 is rotatable about a pivot 73 and connected at its free end to a plunger 75 of a solenoid 74. The arm 71, support plate 72 and pivot 73 in combination serve as means for supporting the magnet 70. On the other hand, the solenoid 74 serves as means for shifting the magnet 70.

During a period other than the image forming period for forming a toner image on the drum 18, e.g., for several seconds to several minutes after the turn-on of a main switch of the copier or in the film removing mode which follows an image forming procedure, the magnet 70 assumes a first position where it neighbors the cleaning sleeve 32, as indicated by a solid line in FIG. 9. In this condition, a magnetic field is developed between the magnets P1 and 70, i.e., in the region X where the cleaning sleeve 32 and drum 18 face each other. The magnetic field retains a magnet brush B (FIG. 8) formed by the cleaning agent C in the region X. The magnet brush B removes a film from the rotating drum 18 by urging itself against the drum 18 with a relatively great force. When the film removing operation is not performed, the solenoid 74 is energized to pull the plunger 75. Then, the support plate 72 is rotated about the pivot 73 to a position indicated by a phantom line in FIG. 9, resulting in the magnet 70 being moved away from the cleaning sleeve 32 to a second position as also indicated by a phantom line. As a result, the magnetic field between the magnets 70 and P1 substantially disappears to cancel the restraint on the magnet brush B. Consequently, the cleaning agent forming the magnet brush B is transported to the case 40 by the rotation of the cleaning sleeve 32.

If desired, the magnet 70 may be moved back and forth between the first and second positions while the film removing operation is performed once. Then, the cleaning agent C will form a magnet brush B every time the magnet 70 is brought to the first position. The magnet 70 is located at the right-hand side of the region X, as stated earlier. Hence, when the magnet brush B on the cleaning sleeve 32 breakes up on the shift of the magnet 70 to the second position, the cleaning agent having formed the brush B is positively retained by the force of the spring P1 because it necesarily passes the region X. The agent is, therefore, prevented from depositing on the drum 18 and being transported by the latter to the outside of the cleaning device 27.

The magnet 70 may be replaced with an electromagnet or a ferromagnetic material, soft magnetic material or similar magnetic material. The rotation speed of the cleaning sleeve 32 may be lowered as in the first specific construction, in interlocked relation to the movement of he magnet 70 toward the cleaning sleeve 32. This will enhance the film removing effect. While the film removing operation is under way, the cleaning sleeve 32 may either be activated or be deactivated.

In any of the specific constructions described so far, the removal of a film is effected during the interval between consecutive series of image forming operations or during a waiting period so as to insure a desirable toner image at all times, as stated earlier. For example, it may be performed after the copying sequence has been repeated with a certain document to produce a desired number of copies or before the start of a series of copying sequences. Ideally, a film removing operation should be continued for a minimum period of time which can sufficiently remove a film. Should the duration of the film removing operation or film removing period be short, a film would not be fully removed; should it be excessive, the carrier in the cleaning agent C would be excessively stressed and have its life reduced.

On the other hand, the filming on the drum 18 increases substantially in proportion to the duration of image forming operation (copying operation), especially the operating time of the developing device. Therefore, if the film removing period is fixed, it will be sometimes short and sometimes excessive depending on the druation of image forming operation which was performed before the film removing operation. Specifically, when the copying sequence is continuously repeated over a long period of time, the cleaning sleeve 32 is rotated for a long period of time for cleaning the drum 18 with the developing sleeve being also rotated for a long period of time. In this condition, since filming particles are apt to deposit on the drum 18, it is preferable to increase the duration of film removing operation or film removing period. Conversely, when the copying period is short, it is preferable to reduce the film removing period and thereby the deterioration of the carrier of the cleaning agent C.

A sixth specific construction which will be described is constructed such that the duration of the various kinds of film removing procedures described above increases substantially in proportion to the duration of image forming operation which was performed immediately before.

Figure 10:
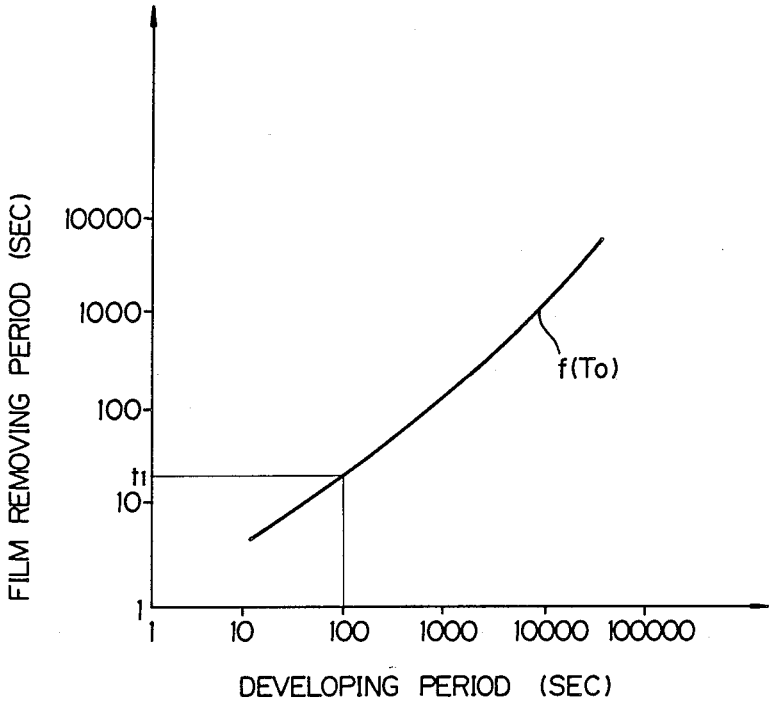
FIG. 10 is a graph showing a relationship between the operating period of a developing device and the film removing period for explaining a sixth specific construction.

FIG. 10 shows a curve representative of a specific ideal relationship between the period of time during which the developing sleeve 50B of the black developing device 21B (FIG. 1) is continuously rotated for development and the duration of film removing operation which occurs thereafter. For example, when development is continued for 100 seconds, it is desirable to effect the film removing operation for a period of time of $t_1$. A film removing period longer than $t_1$ would excessively stress the carrier contained in the cleaning agent, while a film removing period shorter than the same would prevent a film from being fully removed. In the case that the other developing devices 21Y, 21M and 21C are operated to produce a full-color toner image, the film removing period is determined on the basis of the total period of time during which the developing rollers 50Y, 50M and 50C were rotated to complete a series of image forming operations.

If desired, the operating period of the developing device or devices on which the film removing period is based may be replaced with the number of copies produced by a series of image forming operations or the period from the start to the end of a series of image forming operations as counted by a timer, for example.

In the construction described above, when the image forming period is relatively short, e.g., when a single document is to be reproduced only once, the film removing period is also reduced. This saves power associated with the cleaning sleeve 32 and, therefore, the running cost of the copier.

The sixth specific construction is also applicable to the case wherein the cleaning sleeve 32 is repetitively driven at a high speed and a low speed during film removing operation as previously stated. In such a case, while the actual film removing operation occurs a plurality of times intermittently, the total duration thereof is, of course, the film removing period shown in FIG. 10 and stated previously.

The film removing operations of the specific constructions shown and described are executed after a series of image forming operations. An arrangement may be made such that when a person turns on the copy switch of the copier while the film removing operation is under way with the intention of executing an image forming sequence, the image forming sequence is inhibited with priority given to the film removing operation.

Figure 11A:
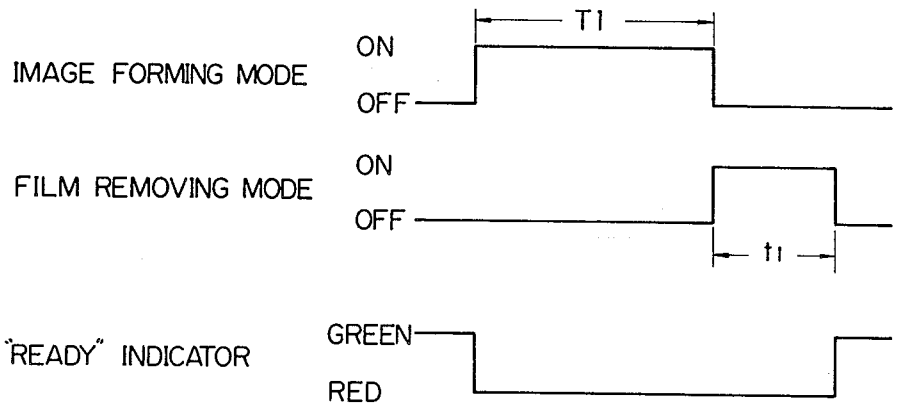
FIGS. 11A to 11C are timing charts representative of a seventh specific construction of the present invention.

FIG. 11A is a timing chart demonstrating the above arrangement. As shown, after a period of time T1 during which the image forming operation (copying operation) has been repeated, a film removing operation is performed for a period of time $t_1$. During the period of time $t_1$, the formation of an image is inhibited. More specifically, from the start of image forming operations to the end of film removing operation, a lamp provided in a display section of the copier continuously glows in red or similar color for showing that the formation of an image is not allowed. At the end of the film removing operation, a green lamp, for example, is caused to glow to show that the formation of an image is allowed, i.e., that the copier is ready to operate.

Figure 11B:
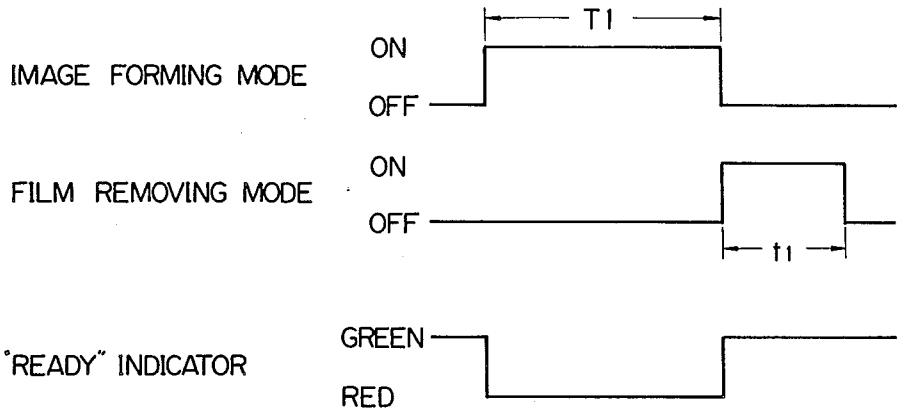
Figure 11C:
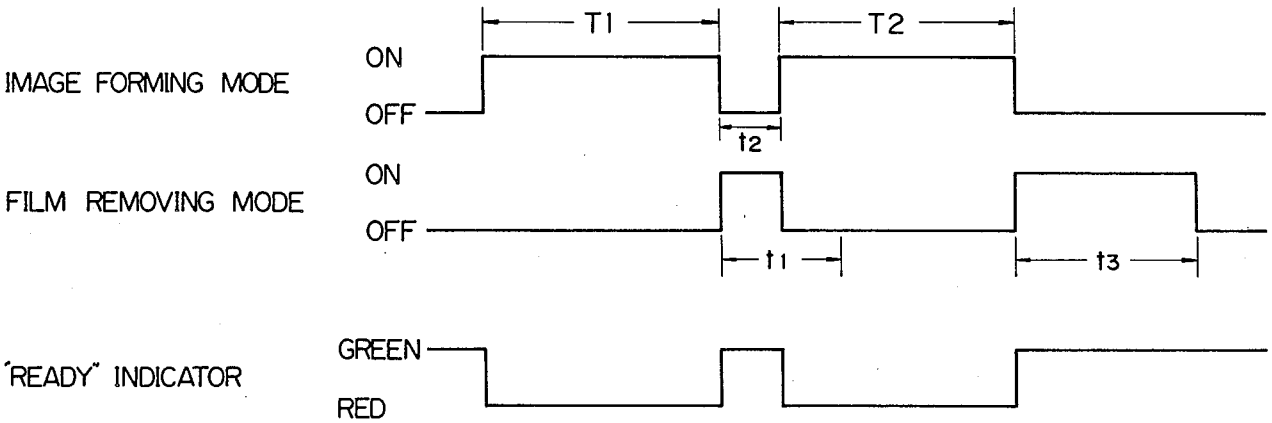

However, a problem with the above construction is that a person has to wait until the film removing operation ends. FIGS. 11B and 11C are timing charts representative of a seventh specific construction of the present invention which solves such a problem. As shown in FIG. 11B, the seventh specific construction alos executes a film removing operation for the period of time $t_1$ after the end of image forming operations. As shown in FIG. 11C, when the operator turns on the copy switch to enter an image formation command while the film removing operation is under say, the seventh construction interrupts the film removing operation and, executes the formation of an image. This frees the operator from the waiting time. Nevertheless, if the film removing operation is simply ended halfway as mentioned above, it will sometimes be impossible to fully remove a film. Therefore, as shown in FIG. 11C, the image forming operation which continues for a certain period of time T2 after the interruption of the film removing operation is followed by a film removing operation the duration of which is $t_3$. This duration $t_3$ is the sum of time $t_1$ and the time which was cut off previously. This kind of implementation eliminates insufficient removal of a film.

Hereinafter will be described a more specific construction which is the combination of the sixth and seventh constructions.

Figure 12:
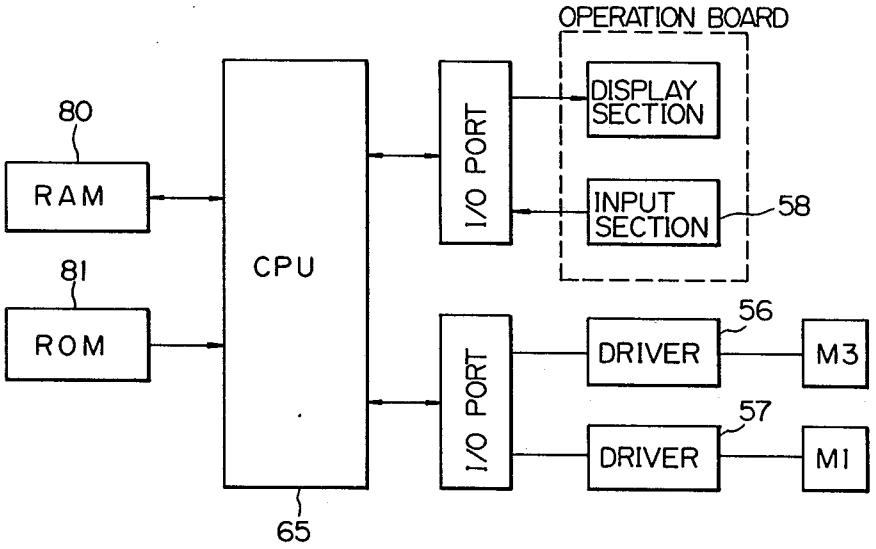
FIG. 12 is a block diagram showing control means applicable to the sixth and seventh specific constructions.

Referring to FIG. 12, the more specific construction has the CPU 65 installed in the copier, a developing motor M3 for driving the developing sleeve 50B of the black developing device 21B (FIG. 1) and implemented as a stepping motor, and the motor M1 for driving the cleaning sleeve 32 as stated with reference to FIG. 7. The operation of the construction shown in FIG. 12 will be described with reference to FIG. 13.

Figure 13:
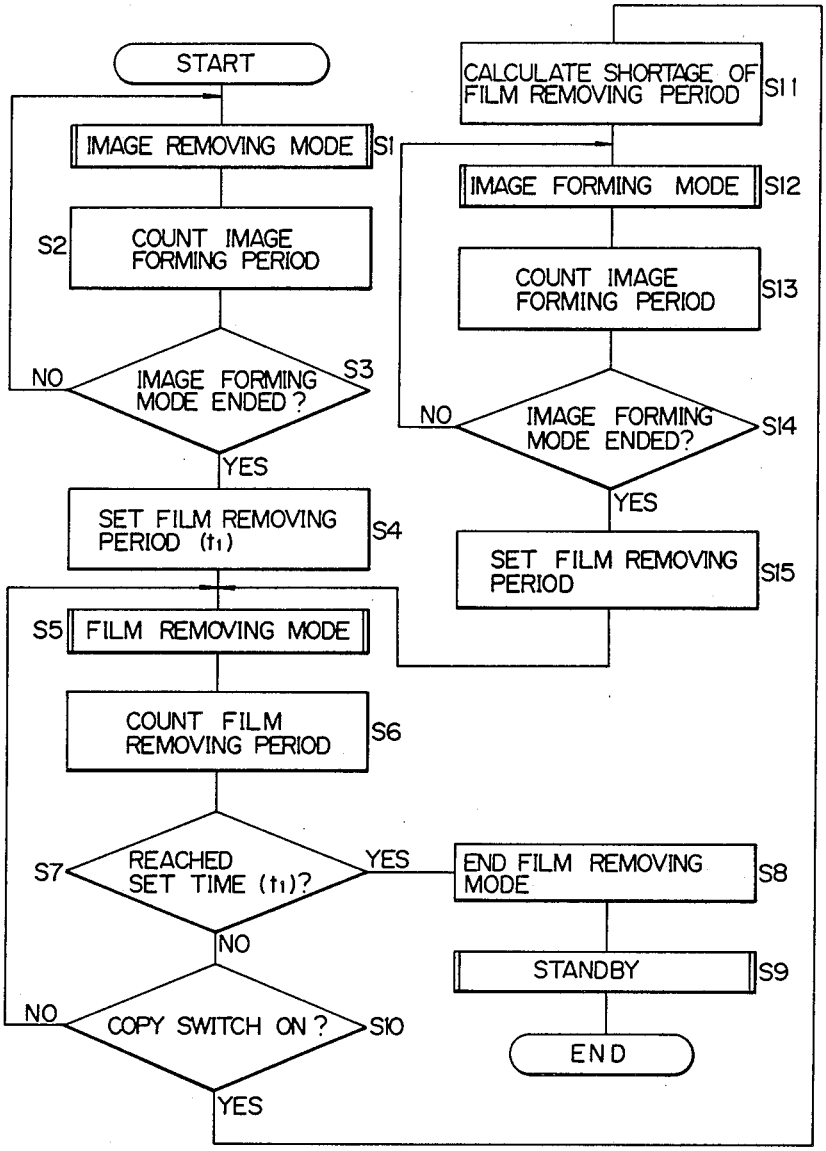
FIG. 13 is a flowchart demonstrating a specific operation of the control means shown in FIG. 12.

In FIG. 13, when the copy switch provided in an inputting section 58 is turned on, an image formation command is fed to the CPU 65. At this stage of operation, assume that the copier is to perform a black-and-white image forming operation in response to the above command (step S1). The CPU 65 drives the motor M3 via a driver 56 and thereby rotates the developing sleeve 50B (FIG. 1) for starting an image forming operation. The duration of image forming operations, i.e., the duration of energization of the motor M3 is counted by a counter (or timer) built in the CPU 65 (step S2), while the duration is stored in a RAM 80 (FIG. 12). Assume that the duration of image forming operations or image forming period is T1, as shown in FIGS. 11B and 11C. A ROM 81 (FIG. 12) is loaded with the curve of FIG. 10 or a function f(TS) approximate to the curve beforehand.

After the image forming operations have been ended (step S3), the CPU 65 selects an optimum film removing period f(T1) on the basis of the image forming period T1 having been stored in the RAM 80 and the function f(TS) loaded in the ROM 81 (step S4). Specifically, when the developing period T1 is 100 seconds, the film removing period $t_1$ is selected, as stated with reference to FIG. 10 earlier. Then, the CPU 65 causes the driver 57 to drive the motor M1 and, therefore, the cleaning sleeve 32 at a low speed for the period of time $t_1$ to thereby execute a film removing operation (step S5). While this removing operation is particular to the first specific construction, it may be replaced with the film removing operation of any other specific construction.

By the sequence of steps described above, the operation of the sixth specific construction is executed.

While the film removing opertion is under way as described above, its duration is counted by the counter of the CPU 65 and stored in the RAM 80 (step S6). Whether or not the actual film removing period has reached the set film removing period $t_1$ is determined (step S7). If the answer of the step S7 is YES, the system is restored to a standby state with the film removing operation being terminated (steps S8 and S9). If the answer of the step S7 is NO, whether or not the copy switch has been turned on is determined (step S10). If the answer of the step S10 is YES, meaning that the copy switch has been turned on on the lapse of a period of time $t_2$ ($<t_1$) after the start of the film removing operation as shown in FIG. 11C, the CPU 65 subtracts the period $t_2$ from the period $t_1$. The periods $t_1$ and $t_2$ have been stored in the CPU 65. The result of the subtraction $t_1 - t_2$ is representative of the shortage of film removing period and stored in the RAM 80 (step S11). This is followed by an image forming operation based on the turn-on of the copy switch (step S12). The duration T2 (FIG. 11C) of the image forming operation is counted (step S13) and stored in the RAM 80. On the completion of the image forming operation (step S14), a film removing period is selected again (step S15). At this time, f(T2) is set on the basis of the function f(TS) loaded in the ROM 81 and is added to the difference between $t_1$ and $t_2$ which has been stored in the RAM 80. The resulting sum $t_3$ (FIG. 11C) is selected as a film removing period, and a film removing operation is executed for the period of time $t_3$ (step S5). It is to be noted that the time f(T2) is an ideal film removing period associated with the image forming period T2. Such a procedure eliminates the shortage of film removing period and, yet, precludes excessive filming.

While each of the specific constructions shown and described rotates the drum 18 for the removal of a film at the same speed as during ordinary image forming operation, it may be modified to rotate the drum 18 at a higher speed than during ordinary image forming operation so as to further enhance efficient removal of a film. The modified construction will hereinafter be referred to as a ninth specific construction. The ninth specific construction is applicable to all of the specific constructions previously described. Especially, it is advantageously applicable to the combination of the first specific construction which reduces the speed of the cleaning speed during film removing operation and the eighth specific construction. The eighth construction is such that $0 < |VS/VS| < 0.5$ is satisfied during film removing operation. This relationship may be satisfied by reducing the speed of the cleaning sleeve 32 only. However, if the sleeve 32 is rotated at an excessively low speed, the motor for driving the sleeve 32 and the sleeve 32 itself are apt to become unstable concerning the rotation. Hence, increasing the speed of the drum 18 during film removing operation is successful in satisfying the above relationship without the speed of the sleeve 32 being noticeably reduced.

Figure 14:
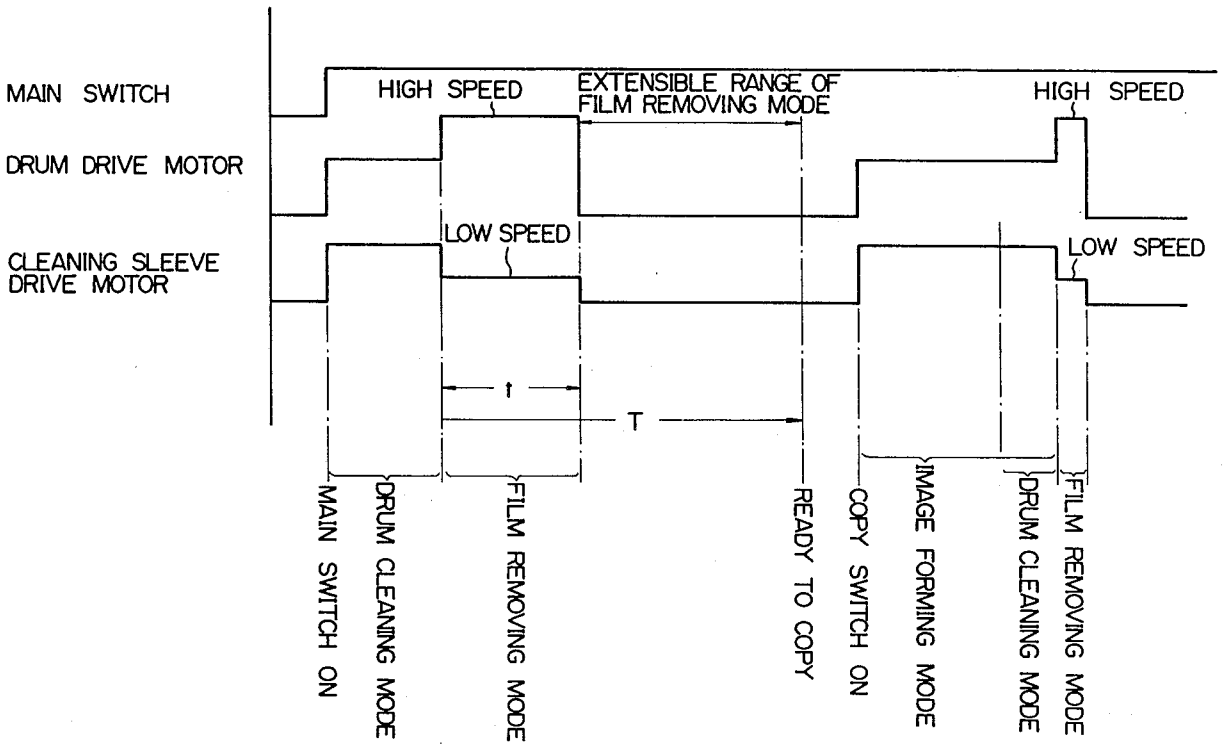
FIG. 14 is a timing chart similar to FIG. 3, showing a ninth specific construction.

FIG. 14 is a timing chart similar to FIG. 3 and demonstrating the operation of the ninth specific construction which is applied to the first specific construction by way of example. In FIG. 14, the motor M2 (FIG. 7) for driving the drum 18 is implemented as a variable speed motor such as a stepping motor and controllably driven by the CPU. For example, the drum 18 and the cleaning sleeve 32 are respectively rotated at 200 millmeters per second and 300 millimeters per second in the ordinary image forming mode, while the cleaning sleeve 32 and the drum 18 are respectively driven at a low speed and a high speed in the film removing mode. The procedure shown in FIG. 4 differs from the procedure of FIG. 3 in that the drum 18 is driven at a high speed in the film removing mode.

The developing units 21Y, 21M, 21C and 21B shown in FIG. 1 have developing sleeves 50Y, 50M, 50C and 50B, respectively, for transporting a mixture of toner and carrier while magnetically retaining it thereon, and the doctor blade 51 is provided for regulating the amount of developer in transport. When the copier has this kind of developing units, the developing units and doctor blade may be used to remove a film from the drum 18 in the same manner as in the specific constructions shown described. Specifically, the developer plays the role of the agent for scraping a film off the drum 18, the developing sleeve serves as the agent carrier for carrying the agent, and the doctor blade serves as the means for regulating the amount of agent being transported to between the image carrier and the agent carrier. By substituting these components for the cleaning agent C, cleaning sleeve 32 and doctor blade 36 of any of the specific constructions, it is possible to apply the specific constructions to the developing units. For example, to apply the first specific construction to the developing units, at least one of the developing sleeves 50 to 50B is rotated at a low speed to feed a great amount of agent (developer in this case) to the region where the developing sleeve faces the drum 18 so as to remove a film from the drum 18. This is also true for the other specific constructions.

Of course, any one of the specific constructions shown and described which use a cleaning device or developing units as described above is applicable to a monochromatic copier which is provided with a single developing unit. Generally, the cleaning agent C retained on the cleaning sleeve 32 is lower in toner concentration than the developer retained on the developing sleeve. Therefore, when the cleaning agent C of the cleaning device 27 is rubbed against the drum 18 for removing a film, carrier particles in the agent C will contact the drum 18 with a greater probability to further enhance the film removing effect, compared to the case wherein the developer on the developing sleeve is used. Concerning the drum cleaning effect, it is preferable to use a cleaning agent C containing carrier particles the shape of which is not uniform, i.e., angular particles, as stated earlier. Such an angular carrier also serves to promote the film removing effect. On the other hand, carrier particles contained in the developer which is retained on the developing sleeve is usually spherical and, therefore, somewhat lower than the carrier of the cleaning agent C with respect to the film removing effect. In this respect, the method of the present invention will be more effective when applied to the cleaning device than when applied to the developing device. If desired, the present invention may be applied to both of the developing device and the cleaning device for scraping a film off the drum 18 in a shorter period of time.

While the illustrative constructions have been concentrated on the cleaning sleeve 32 or the devoloping sleeve which is driven in a rotary motion relative to stationary magnets, the present invention is similarly applicable to an arrangement wherein the magnets and the sleeve are rotated relative to each other for transporting the cleaning agent C or the developer. In such a case, in the film removing mode, the rotation speed of magnets or that of the sleeve will be controlled to in turn control the amount of cleaning agent C or that of developer being transported to between the sleeve and the drum 18.

Figure 15:
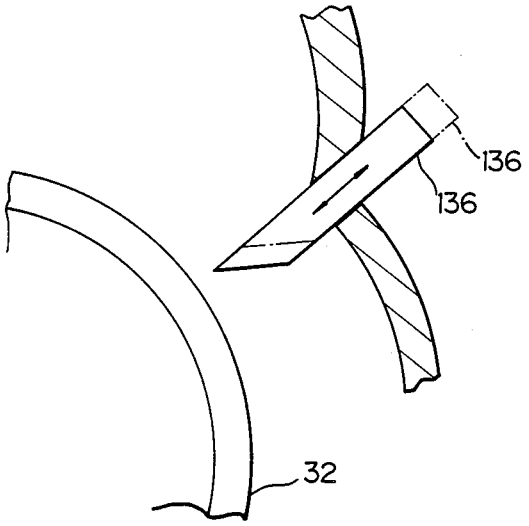
FIG. 15 is a fragmentary view showing an alternative form of means for regulating the amount of agent being transported.

The cleaning sleeve 32 of each specific construction is rotated at a low speed for transporting a greater amount of cleaning agent C to the cleaning region X. An alternative implementation for transporting a great amount of cleaning agent to the region X is shown in FIG. 15. In FIG. 15, a doctor blade 136 corresponding to the doctor blade 36 of FIG. 2 is supported in such a manner as to be movable toward and away from the cleaning sleeve 32. Specifically, the doctor blade 136 is held stationary in a solid line position in the ordinary cleaning mode, and it is moved away from the cleaning sleeve 32 to a phantom line position in the film removing mode so as to broaden the gap between the blade 136 and the sleeve 32. The blade 136 may be so moved by a solenoid or a motor, for example. The movable blade 136 and the solenoid, motor or similar driving device, therefore, implement means for transporting a great amount of cleaning agent to the region X in the film removing mode, or means for controlling the amount of agent being fed to the region X such that it decreases when the rotation sped of the image carrier or that of the agent carrier is lowered to zero or beyond a predetermined value. This kind of arrangement is also applicable to the case wherein the developing device is used to remove a film, i.e., the blade 51 shown in FIG. 1 may be movably supported and actuated by a driving device.

It is to be noted that the present invention is applicable not only to a copier but also to a printer, facsimile machine or any other image forming appratus. The present invention is practicable even when the image carrier or the agent carrier is implemented as a belt.

The principle of the fourth specific construciton which reduces the amount of agent in transport may be adopted for the ordinary cleaning operation also. Specifically, when the rotation speed of the cleaning sleeve 32 or that of the drum 18 is lowered while the cleaning sleeve 32 is in operation, it may be sensed to reduce the amount of cleaning agent being transported to the region X by, for example, increasing the rotation speed of the cleaning sleeve 32 and to thereby free the sleeve 32 and drum 18 from an excessive load. The decrease in the rotation speed of the cleaning sleeve 32 or that of the drum 18 will occur when the gap between the cleeve 32 and the drum 18 is stopped by some cause.

In summary, the present invention has various unprecedented advantages, as enumerated below.

(1) A film can be removed from an image carrier effectively and, yet, economically without reducing the life of the image carrier.

(2) The image carrier and an agent carrier are free from an excessive load which would otherwise be created by a mass of cleaning agent staying between the image carrier and the agent carrier and would eventually stop the movement of the latter.

(3) There are eliminated excessive film removing periods which would accelerate the degradation of a carrier and short fim removing periods which would result in insufficient removal of films.

(4) The operator is freed from a waiting time and, yet, the shortage of film removing period is eliminated.

(5) The efficiency of film removal is increased with respect to time.

Various modifications will become possible for those skilled in the art after receiving the teachings of the present disclosure without departing from the scope thereof.

What is claimed is:

1. In a method of removing a film from an image carrier of an image forming apparatus comprising said image carrier which is movable for forming a toner image on said image carrier in an image forming mode, a movable agent carrier located to face said image carrier for magnetically retaining an agent and transporting said agent to a region between said image carrier and said agent carrier while causing said agent to form a magnet brush, and regulating means for regulating an amount of said agent being transported to said region, the improvement wherein at a time when said image forming mode for forming the toner image on said image carrier is not under way, a film removing mode is executed by controlling movement of said image carrier and movement of said agent carrier such tah an adequate amount of said agent is transported to said region.

2. A method as claimed in claim 1, wherein the agent comprises a cleaning agent composed of a carrier and a toner.

3. A method as claimed in claim 2, wherein a moving speed of said agent carrier is lowered to transport a greater amount of the agent to said region than in a cleaning mode.

4. A method as claimed in claim 1, wherein said agent carrier is brought to a stop with said image carrier being moved.

5. A method as claimed in claim 1, wherein said agent carrier is repetitively stopped and moved with said image carrier being moved.

6. A method as claimed in claim 1, wherein when the moving speed of at least one of said agent carrier and said image carrier being sensed is reduced to zero or beyond a predetermined value, the movement of said agent carrier is controlled to reduce the amount of the agent being transported to said region.

7. A method as claimed in claim 6, wherein the moving speed of said agent carrier is increased.

8. A method as claimed in claim 1, wherein said image forming apparatus further comprises magnets for retaining the agent on said agent carrier, and a counter magnet facing said magnets for generating a magnetic field in said region in cooperation with said magnets.

9. A method as claimed in claim 8, wherein said counter magnet is movable to a retracted position where said counter magnet does not generate the magnetic field, when said film removing mode is not executed.

10. A method as claimed in claim 1, wherein a duration of said film removing mode is increased with an increase in a duration of said image forming mode which occurred immediately before said film removing mode.

11. A method as claimed in claim 1, wherein when an image formation command is entered while said film removing mode which is to to continue for a predetermined period of time is under way, said film removing mode is interrupted to execute image formation with priority given to said image formation and, on termination of said image formation, said film removing mode is executed again for said predetermined period of time plus a residual of said predetermined period of time of said film removing mode previously executed.

12. A method as claimed in claim 1, wherein assuming that said agent carrier and said image carrier are moved respectively at a linear velocity VS and a linear velocity VP, said linear velocities are selected, when the agent is to be fed in an amount great enough to scrape a film off said image carrier, such that a relation $0<|VS/VP|<0.5$ is satisfied.

13. A method as claimed in claim 1, wherein a linear speed of said image carrier is increased in said film removing mode than in said image forming mode.

* * * * *